US006474469B1

(12) United States Patent
Luton et al.

(10) Patent No.: US 6,474,469 B1
(45) Date of Patent: Nov. 5, 2002

(54) PACK FOR SMOKING ARTICLES

(75) Inventors: Colin Dennis Luton, Bristol; Rodney George Taylor, Woodhouse Eaves, both of (GB)

(73) Assignee: Imperial Tobacco Limited, Bristol (GB)

( * ) Notice: Subject to any disclaimer, the term of this patent is extended or adjusted under 35 U.S.C. 154(b) by 0 days.

(21) Appl. No.: 09/744,024

(22) PCT Filed: Jul. 2, 1999

(86) PCT No.: PCT/GB99/02118

§ 371 (c)(1),
(2), (4) Date: Mar. 5, 2001

(87) PCT Pub. No.: WO00/05151

PCT Pub. Date: Feb. 3, 2000

(30) Foreign Application Priority Data

Jul. 22, 1998 (EP) ..... 98305845

(51) Int. Cl.[7] ..... B65D 85/10
(52) U.S. Cl. ..... 206/268; 206/459.5; 229/160.1
(58) Field of Search ..... 206/242, 256, 206/268, 271, 273, 459.5; 229/116.1, 145, 146, 160.1

(56) References Cited

U.S. PATENT DOCUMENTS

| | | | | | |
|---|---|---|---|---|---|
| 2,886,234 | A | * | 5/1959 | Toensmeier | 206/268 |
| 3,018,878 | A | * | 1/1962 | Watkins | 206/268 |
| 3,910,487 | A | * | 10/1975 | Jaeschke | 229/160.1 |
| 4,948,038 | A | * | 8/1990 | Moeller | 229/146 |
| 5,024,376 | A | * | 6/1991 | Focke | 229/160.1 |
| 5,265,799 | A | * | 11/1993 | Stone | 229/160.1 |
| 5,511,722 | A | * | 4/1996 | Dixon | 229/160.1 |
| 5,749,462 | A | * | 5/1998 | Houghton | 206/268 |
| 5,826,785 | A | * | 10/1998 | Belvederi et al. | 206/273 |
| 6,138,823 | A | * | 10/2000 | Focke | 206/268 |

FOREIGN PATENT DOCUMENTS

| | | | |
|---|---|---|---|
| DE | 195 22 894 | * | 2/1996 |
| EP | 0837012 | * | 4/1998 |

* cited by examiner

*Primary Examiner*—Jim Foster
(74) *Attorney, Agent, or Firm*—Larson & Taylor PLC

(57) ABSTRACT

A pack for smoking articles having a cut-away section in the front which reveals a backing member. The backing member may be hingedly connected to the front panel of the pack by Z-folds to ensure identical color and location registration in the cut-away.

15 Claims, 6 Drawing Sheets

PACK FOR SMOKING ARTICLES

Figure 1:
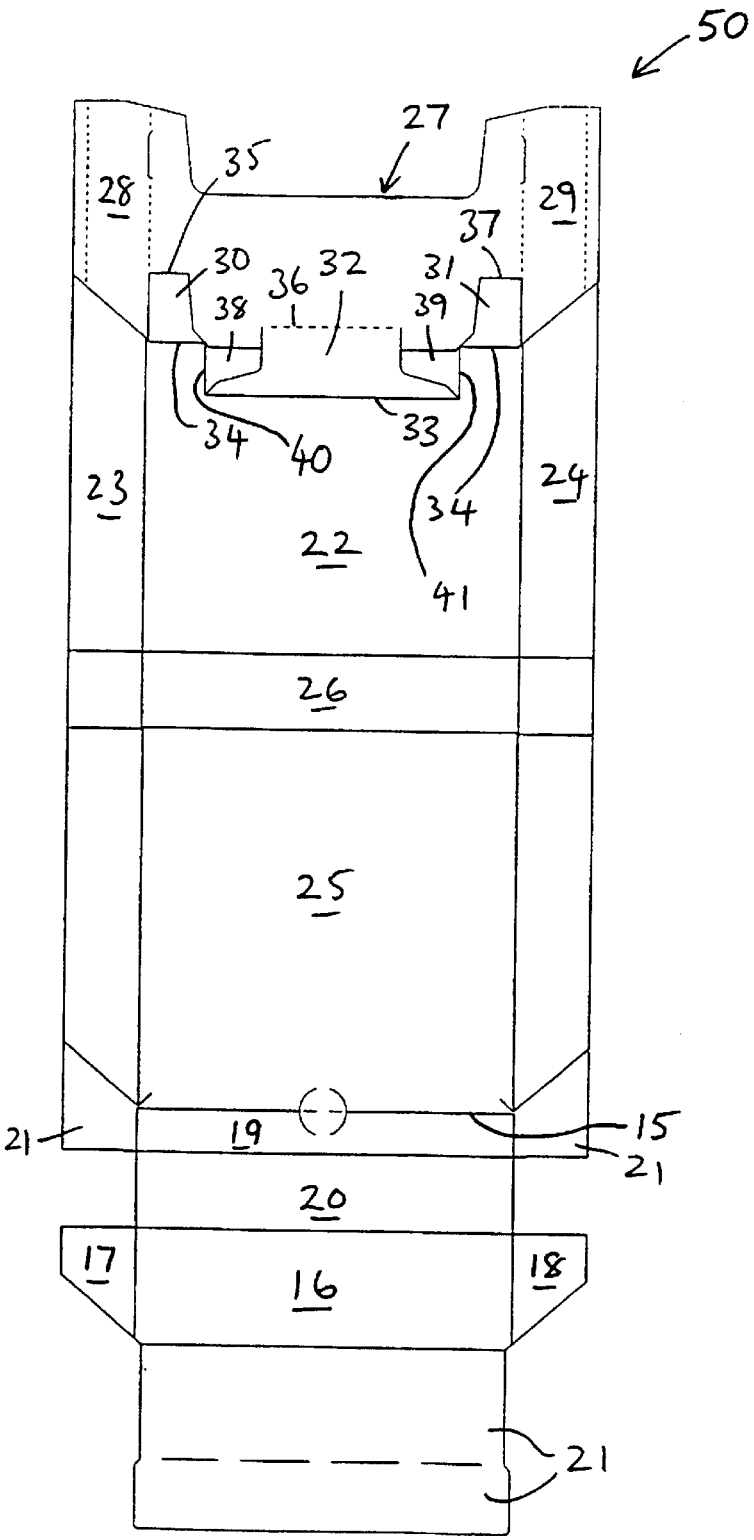

The present invention relates to packs for smoking articles.

According to the present invention there is provided a pack for elongate smoking articles comprising a lid hingedly connected to a body, both the lid and the body each having front, rear and a pair of side panels, the lid having a top panel remote from the body which has a base panel remote from the lid, said hinge connection being defined by a fold between the rear lid panel and the rear body panel and being substantially parallel to the top and bottom edges of the pack, the front of the pack having a portion that is cut away to reveal a backing member disposed within the pack and the hinge connection also being substantially parallel to an imaginary line extending between the lowermost points of the side edges of the front of the lid.

The cut-away portion may be located in the body front panel or the lid front panel or in a combination of both. Where there is no cutaway portion in the lid then said imaginary line coincides with the lowermost edge of the lid front panel. In many embodiments the cutaway portion is enclosed on all sides by the front panels of the body and/or lid.

Preferably at least some of the edges defining the cut-away portion have sections folded inwardly of the body so that the backing member is more inwardly recessed behind the body front panel. In further preferred arrangements all of the edges defining the cut-away portion have inwardly folded sections, no cut edges therefore being presented by the cut-away portion.

In some arrangements the upper extremity of the cut-away portion is closed by the lower edge of the front lid panel when the pack is closed, the lower edge of the front lid panel abutting the upper edge of the front body panel. Conveniently the backing member is formed integrally with and is hingedly connected with respect to the upper edge of the front body panel.

A preferred feature is that the backing member is connected to the upper edge of the front body panel by means of two spaced tabs which form Z-folds.

In certain embodiments the cut-away portion is defined wholly within the front body panel. In other arrangements the cut-away portion borders on the upper edge of the front body panel so that the cut-away portion is open at its upper extremity.

Preferably the backing member is also connected to a lower edge of the cut-away portion by means of an intermediate tab which also forms a parallel Z-fold, the longitudinal depth of the intermediate tab being substantially the same as that of the two spaced tabs. Also, the cut-away portion has a pair of lateral edges extending between respective ends of the lower edge of the cut-away portion and the upper edge of the front body panel such that the cut-away portion is defined by its lateral edges and its lower edge. Preferably said lateral edges have sections folded inwardly of the body and in some cases the intermediate tab extends for the full lateral width of the lower edge of the cut-away portion.

Conveniently the backing member is hingedly connected to side members which lie inwardly of the respective body side panels and project upwardly therefrom. Ideally, the part of the backing member which lies behind the cut-away portion of the front body panel has printed matter thereon.

With some embodiments there is also an inner frame provided in the body of the pack.

In some packs, adjacent side, front and rear panels meet each other at right angles. In others, adjacent side, front and rear panels are interconnected by means of sub-panels such as lengthwise bevel panels or lengthwise contoured panels which may incorporate a number of parallel, lengthwise extending score lines.

Figure 2:
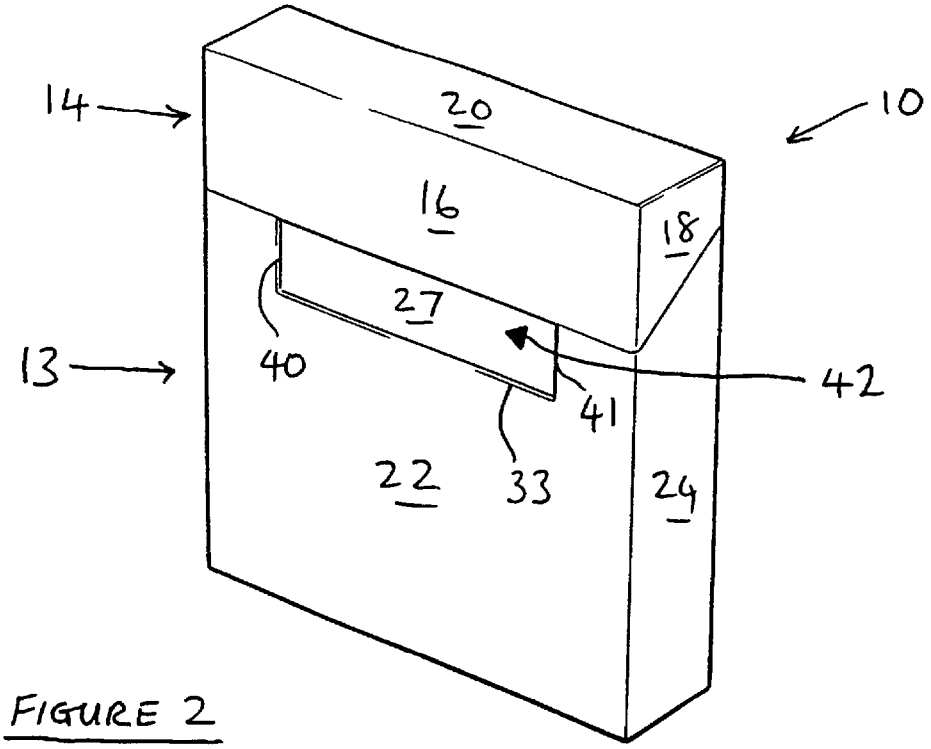
Figure 4:
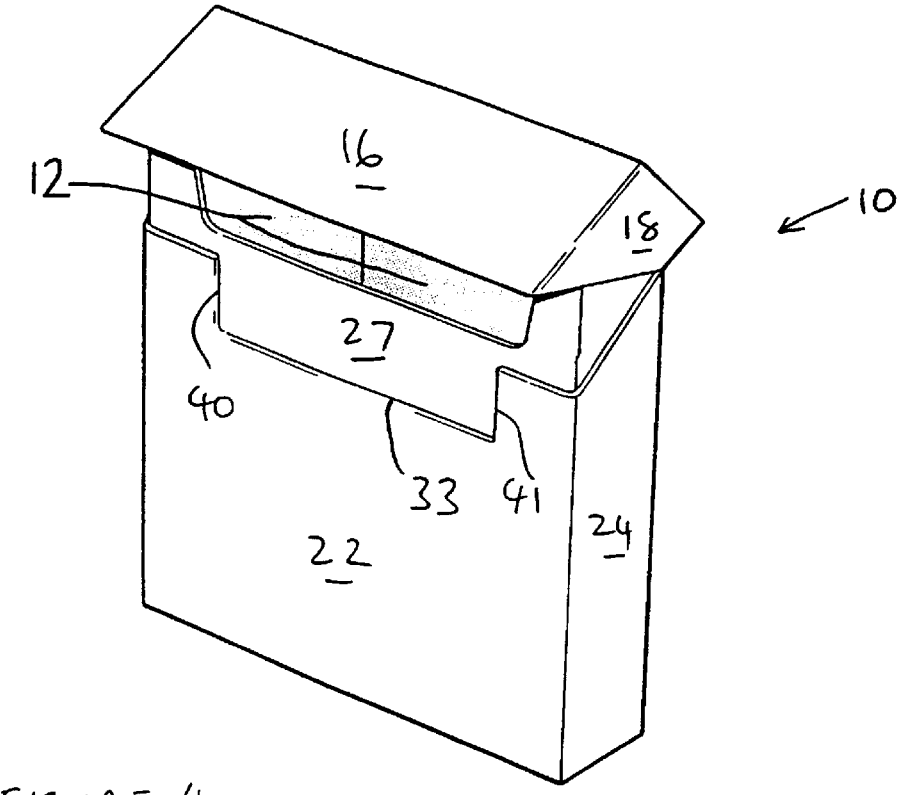
Figure 3:
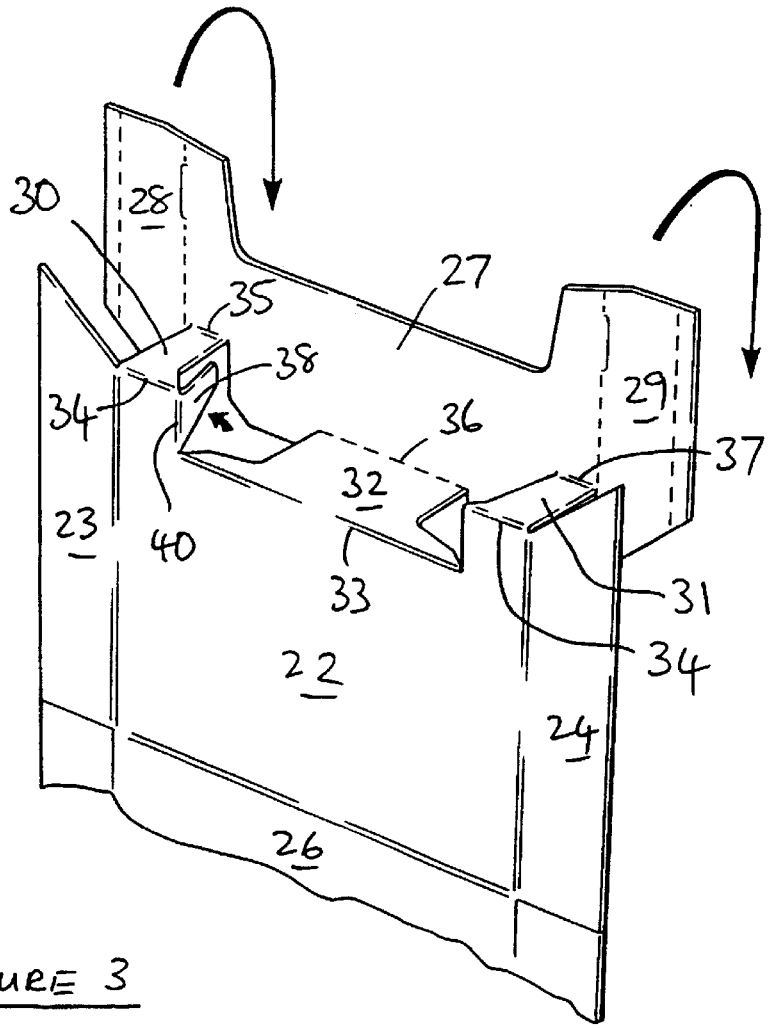
Figure 9:
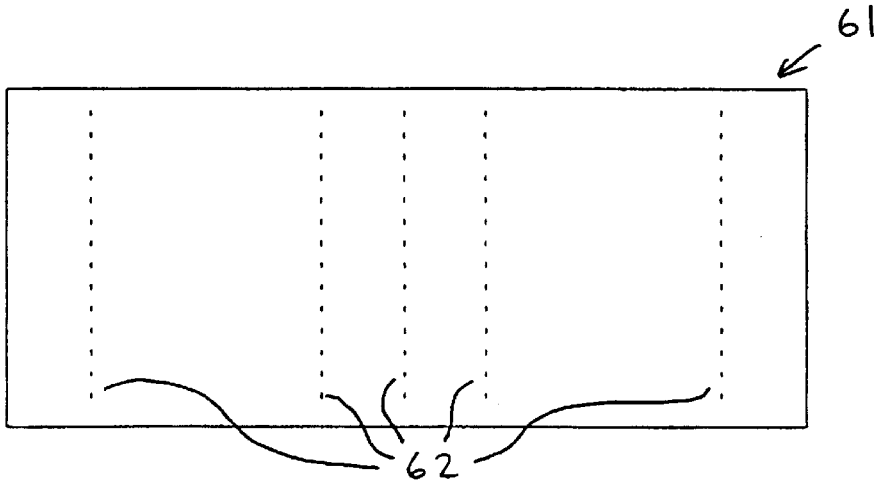
Figure 5:
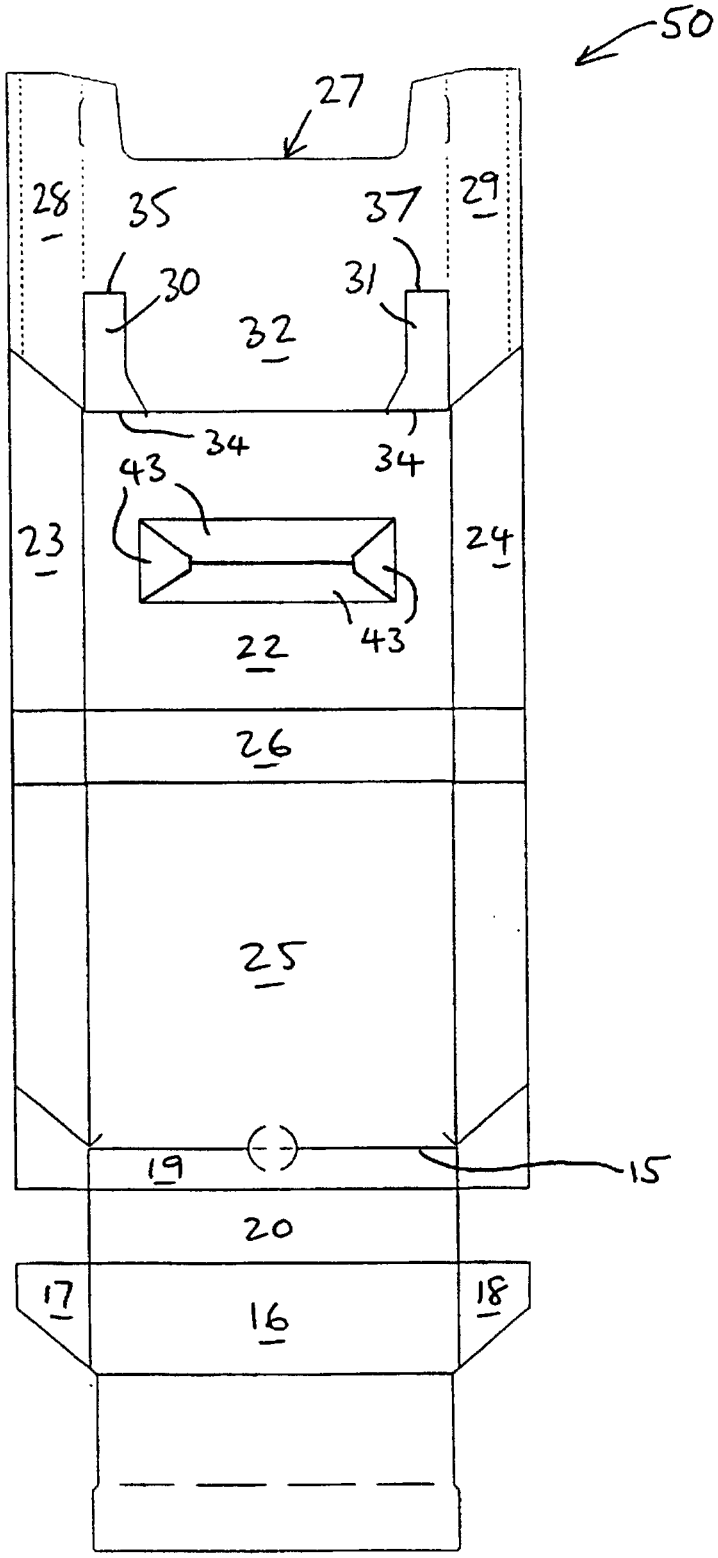
Figure 6:
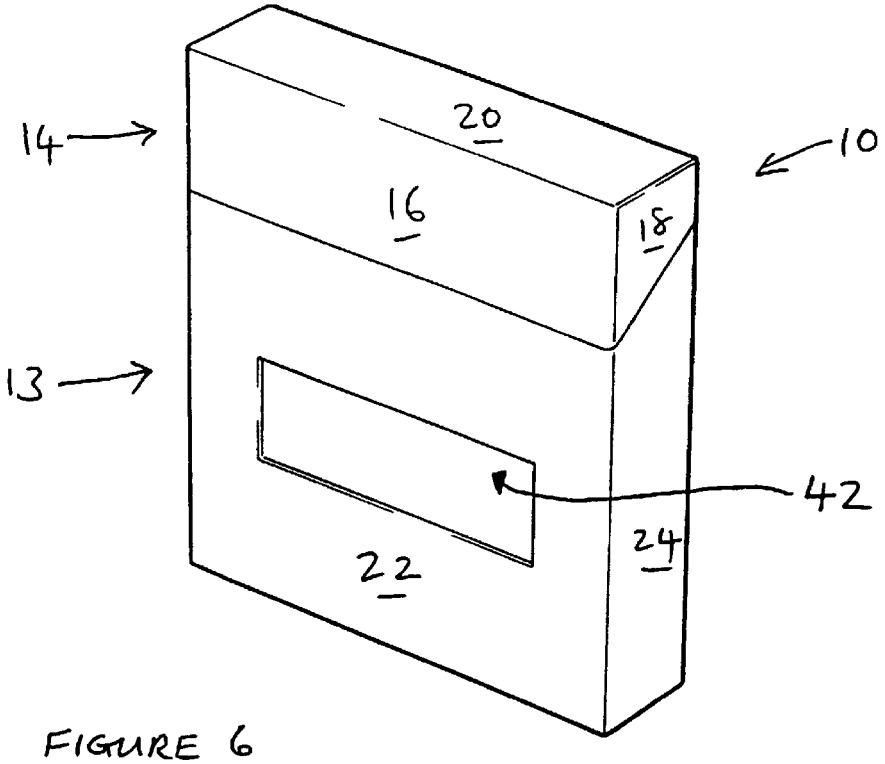
Figure 8:
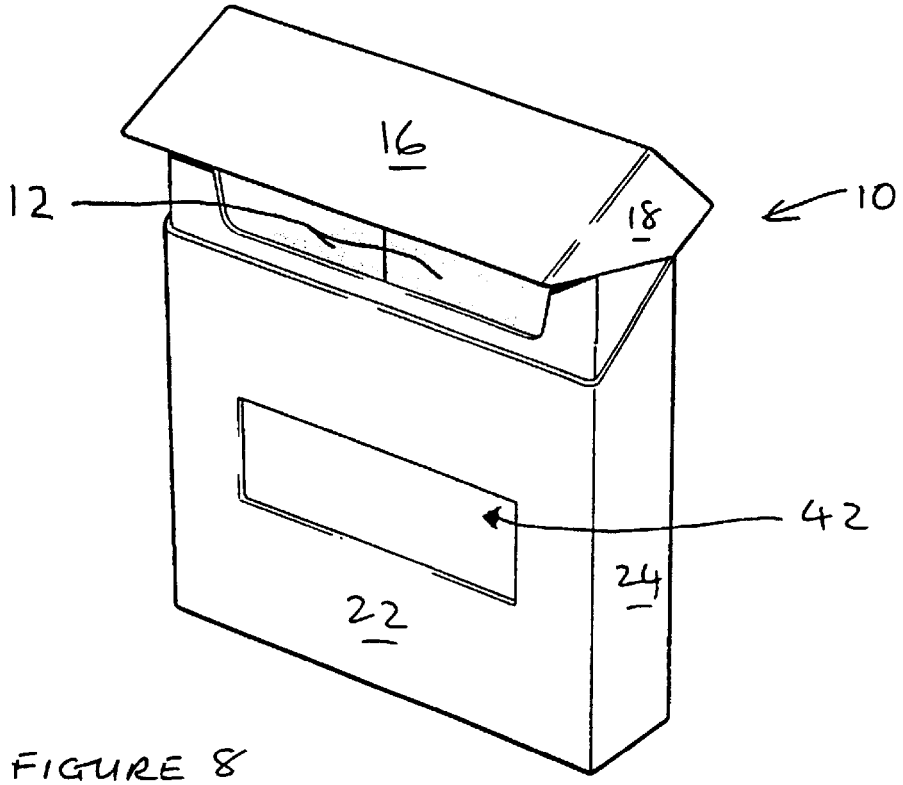
Figure 7:
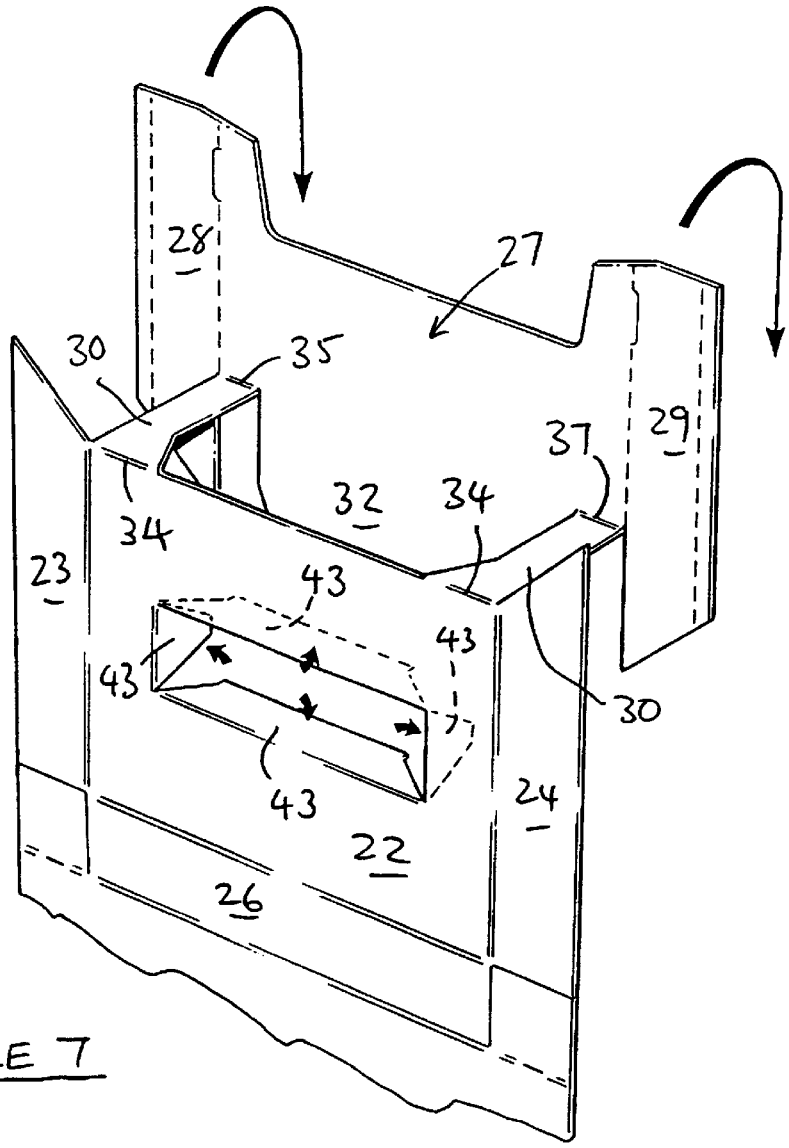
Figure 10:
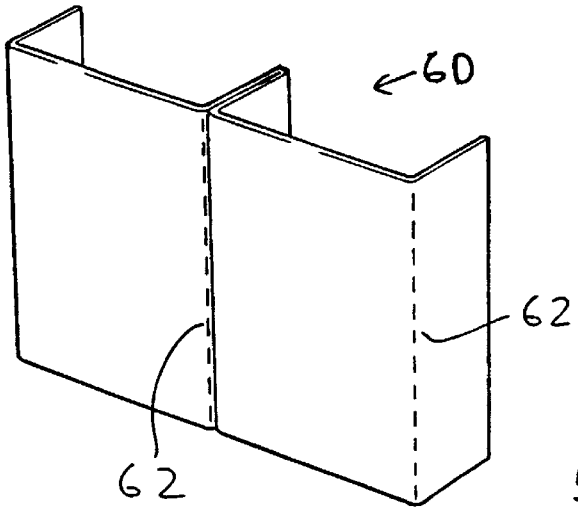

Embodiments of the invention will now be described in more detail. The description makes reference to the accompanying drawings in which:

FIG. 1 shows a blank for producing a pack according to the present invention, FIG. 2 is a front perspective view of the pack formed from the FIG. 1 blank in a closed position, FIG. 3 is a perspective view of part of the pack during assembly, FIG. 4 is a perspective view of the assembled pack in an open position, FIGS. 5 to 8 are views similar to FIGS. 1 to 4 of a second embodiment, FIG. 9 shows a blank for an optional inner frame, and FIG. 10 is a perspective view of the inner frame formed from the blank of FIG. 9.

FIGS. 1 to 4 show a paperboard blank 50 for making a generally rectangular pack 10 for a number of elongate smoking articles such as cigarettes. The pack 10 shown is for twenty cigarettes in two 2×5 bundles 12 of cigarettes. The pack 10 has a main body 13 and a lid 14 which is hingedly connected to the main body 13 by means of a fold line 15.

The lid 14 has a front panel 16, side panels 17, 18, a rear panel 19 and a top panel 20. In the blank 50 for producing the pack 10 there are a number of other panels 21 which form part of the lid 14 but which are located internally of the lid 14. These other panels 21 are known from conventional pack technology and give a folded lowermost edge to the lid.

The main body 13 also has a front panel 22, main side panels 23, 24, a rear panel 25 and a base panel 26. In the assembled pack 10 the panels 22 to 25 are substantially in alignment with the associated panels 16 to 19 of the lid 14 when the pack is in a closed position. Opening of the pack 10 is by relative rotation of the lid 14 and the main body 13 about the fold line 15 linking the two rear panels 19, 25.

An internal collar panel 27 having secondary side panels 28, 29 is foldably connected to the front panel 22 of the main body by means of two spaced lateral tabs 30, 31 and a central intermediate tab 32 disposed between the lateral tabs 30, 31. The heights of all three tabs are the same but the intermediate tab 32 is hingedly connected to the front panel 22 at fold line 33 which is lower than the top edge 34 of the front panel 22 where the lateral tabs 30, 31 are hingedly connected. Upper fold lines 35, 36, 37 respectively connect the tabs 30, 31, 32 to the collar panel 27.

The ends of the intermediate tab 32 are angled inwardly towards the fold line 33 to make provision for sub-panels 38, 39 which are hingedly connected to the front panel 22 of the main body 13 at 40, 41.

An inner frame 60 may also be provided to support the two bundles 12 of cigarettes in the finished pack and an example of frame is shown in FIG. 10, the frame 60 being formed from the blank 61 shown in FIG. 9. The blank 61 is formed from paperboard and has a number of creases 62 to enable the blank to be folded to form the double channel section of the frame 60.

To assemble the pack 10, the sub-panels 38, 39 are folded internally through 180° about the folds 40, 41 so as to lie against the inside of the front panel 22. The collar panel 27 and its secondary side panels 28, 29 are folded inwardly of the front panel 22 by virtue of the Z-folds created by the tabs 30, 31, 32, upper fold lines 35, 36, 37, top edge 34 and fold line 33. The collar panel 27, therefore, sandwiches the intermediate tab 32 against the inside of the front panel 22 with the lateral tabs 30, 31 sandwiching the sub-panels 38, 39 against the inside of the front panel 22.

The pack panels can then be folded and glued in one of a number of conventional methods around the bundles 12 of the cigarettes.

It will be appreciated that the Z-folding of the collar panel 27 relative to the front panel 22 and the folding back of the sub-panels 38, 39 results in the formation of a "window" 42 which is backed by the collar panel 27 and which is effectively closed at its top edge by the lower edge of the front panel 16 of the lid 14. The window is enclosed on all sides by the front panels of the pack. The presence of the folded edges defining three of the sides of the window 42 and the folded lower edge of the lid gives a recessed quality when viewing the collar panel 27 through the window. The collar panel 27 may have matter printed on it such as words, logos or other graphics. The printing can be done at the same time as printing the main panels of the pack thereby guaranteeing a colour match when required and ensuring accurate location of the printed matter in the window.

The size and shape of the window 42 can be varied of course by making appropriate changes to the tab height, width and location although it will be appreciated that with folded edges, only straight edges are possible. Also, more than one window 42 could be provided if the blank was made with more tabs at appropriate locations. Other blank configurations are also possible. For example the sub-panels 38,39 could be laterally shorter so that they do not extend below the tabs 30,31. This would result in a reduction in thickness in this part of the assembled pack.

In an alternative embodiment show in FIGS. 5 to 8, similar parts have been given similar reference numerals. In the alternative embodiment the window 42 is defined entirely within the front panel 22 of the main body and has four sub-panels 43 which are folded inwardly through 180° to give depth to the recess and to ensure there are no cut edges to the window. In this arrangement the intermediate tab 32 between the two lateral tabs 30, 31 is not attached to the front panel 22 and the tabs 30, 31, 32 are of extended height so that the collar panel 27 when folded reaches down to cover the space behind the window 42.

Again the window 42 could be of any chosen shape or size and also the colour match and accurate location can be assured on the backing part of the collar panel 27 which is visible through the window, which has straight edges due to their folded nature.

Simpler arrangements could also be formed by omitting some or all of the sub-panels 38, 39, 43 with the resulting change in depth and edge quality of the window 42. Also the fold 33 could be made into a cut to further modify the lower edge of the window. In this way the movement of the intermediate tab 32 would still produce a window but the lower edge would not be a folded one but a cut one. Where the edges are not folded, they could be curved.

It is also possible to produce packs with windows by omitting the hinge connections between the internal collar panel 27 and the remainder of the blank. The internal collar panel can be provided as an insert between the cigarette bundles 12 and the front panel 22. The edges of the window 24 can still be provided with folded edges or without folded edges or with only some folded edges. Folded edges can still only be straight edges in these embodiments. Assembly of such packs may be easier but colour match and accurate positioning in the window may not be guaranteed. Such packs do, however, enable a full width window to be produced.

Furthermore the junctions between the main panels have been shown as right angles but other constructions such as rounded junctions or bevelled junctions are possible. Other cigarette pack configurations could also incorporate the present invention such as 3-row 20 pack, 10 packs, 3-row 25 packs.

It will also be apparent that, by suitable changes to the blank, the window could be provided in the lid instead of the body or could be provided part in the lid and part in the body.

What is claimed is:

1. A pack for elongate smoking articles comprising:

a lid, a body, and a hinge connection by which the lid is hingedly connected to the body;

front, rear and sides formed by both the lid and the body each having a respective front panel, rear panel, and a pair of side panels;

the lid further having a top panel remote from the body, and the body further having a base panel remote from the lid;

said hinge connection being defined by a fold between the rear lid panel and the rear body panel and being substantially parallel to top and bottom edges of the pack;

the front of the pack having a portion that is cut away to reveal a backing member disposed within the pack;

the hinge connection also being substantially parallel to an imaginary line extending between lowermost points of side edges of the front panel of the lid; and the cut-away portion having edges, with at least some of the edges defining the cut-away portion having sections folded inwardly of the pack so that the backing member is more inwardly recessed behind the front of the pack.

2. A pack as claimed in claim 1 wherein the cut-away portion is located in the body front panel or the lid front panel or in a combination of both.

3. A pack as claimed in claim 2 wherein there is no cut-away portion in the lid so that said imaginary line coincides with a lowermost edge of the lid front panel.

4. A pack as claimed in claim 1 wherein all of the edges defining the cut-away portion have inwardly folded sections.

5. A pack as claimed in claim 1 wherein a lower edge of the front lid panel forms an upper extremity of the cut-away portion when the pack is closed.

6. A pack as claimed in claim 5 wherein the lower edge of the front lid panel abuts an upper edge of the front body panel.

7. A pack as claimed in claim 6 wherein the backing member is formed integrally with and is hingedly connected with respect to the upper edge of the front body panel.

8. A pack as claimed in claim 6 wherein the backing member is connected to the upper edge of the front body panel by two spaced tabs which form Z-folds.

9. A pack as claimed in claim 8 wherein the cut-away portion is defined wholly within the front body panel.

10. A pack as claimed in claim 8 wherein the cut-away portion borders on the upper edge of the front body panel so that the cut-away portion is open at the upper extremity thereof.

11. A pack as claimed in claim 10 wherein the backing member is also connected to a lower edge of the cut-away portion by an intermediate tab which also forms a parallel Z-fold, a longitudinal depth of the intermediate tab being substantially the same as that of the two spaced tabs.

12. A pack as claimed in claim 11 wherein the cut-away portion has a pair of lateral edges extending between respective ends of the lower edge of the cut-away portion and the upper edge of the front body panel such that the cut-away portion is defined by the lateral edges and the lower edge thereof.

13. A pack as claimed in claim 12 wherein said lateral edges have sections folded inwardly of the body.

14. A pack as claimed in claim 1 wherein the backing member is hingedly connected to side members which lie inwardly of the respective body side panels and project upwardly therefrom.

15. A pack as claimed in claim 1 wherein a part of the backing member which lies behind the cut-away portion of the front body panel has printed matter thereon.

* * * * *